US005713294A

United States Patent [19]

Wang

[11] Patent Number: 5,713,294

[45] Date of Patent: Feb. 3, 1998

[54] INFLATABLE BOAT

[75] Inventor: Kenneth Wang, Taipei, Taiwan

[73] Assignee: Team Worldwide Corporation, Taiwan

[21] Appl. No.: 749,500

[22] Filed: Nov. 15, 1996

[51] Int. Cl.[6] ..... B63B 7/00

[52] U.S. Cl. ..... 114/345; 441/40; 440/101; 440/104

[58] Field of Search ..... 441/40, 80, 129, 441/130, 131, 132; 440/13, 17, 21, 22, 23, 24, 101, 102, 104; 114/345

[56] References Cited

U.S. PATENT DOCUMENTS

D. 160,712 10/1950 Kahn ..... 441/129
2,623,574 12/1952 Damsch ..... 441/129
3,256,850 6/1966 Bramson ..... 440/24
4,158,245 6/1979 Cunningham ..... 440/24

*Primary Examiner*—Stephen Avila
*Attorney, Agent, or Firm*—Michael D. Bednarek; Kilpatrick Stockton LLP

[57] ABSTRACT

An inflatable boat comprises an inflatable body, at least one inflatable wing member and at least one holding device. The inflatable wing member is attached onto the inflatable body, while the holding device is connected to the inflatable wing member. Furthermore, the inflatable wing member has a rowing plate on which at least one check valve is provided. The inflatable boat can go ahead on a surface of water when the inflatable wing member is pulled by the holding device to paddle the water.

9 Claims, 7 Drawing Sheets

INFLATABLE BOAT

BACKGROUND OF THE INVENTION

The present invention relates to an inflatable boat, especially to an inflatable boat which has two wings to paddle water and thereby row the boat.

In summer, children like to have fun in the water. Some children sit in inflatable boats (FIG. 7) to enjoy the water and sunshine. When they want to move, they paddle the water with their limbs or oars.

SUMMARY OF THE INVENTION

An object of the present invention is to provide an inflatable boat which can bring more fun to children.

In accordance with the object of the present invention, there is provided an inflatable boat comprising an inflatable body, at least one inflatable wing member and at least one string. The inflatable wing member is attached onto the inflatable body, while the string is connected to the inflatable wing member. Furthermore, the inflatable wing member has a rowing plate on which at least one check valve is provided. The inflatable boat can be propelled on a surface of water when the inflatable wing member is pulled by the string to paddle the boat.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 1:
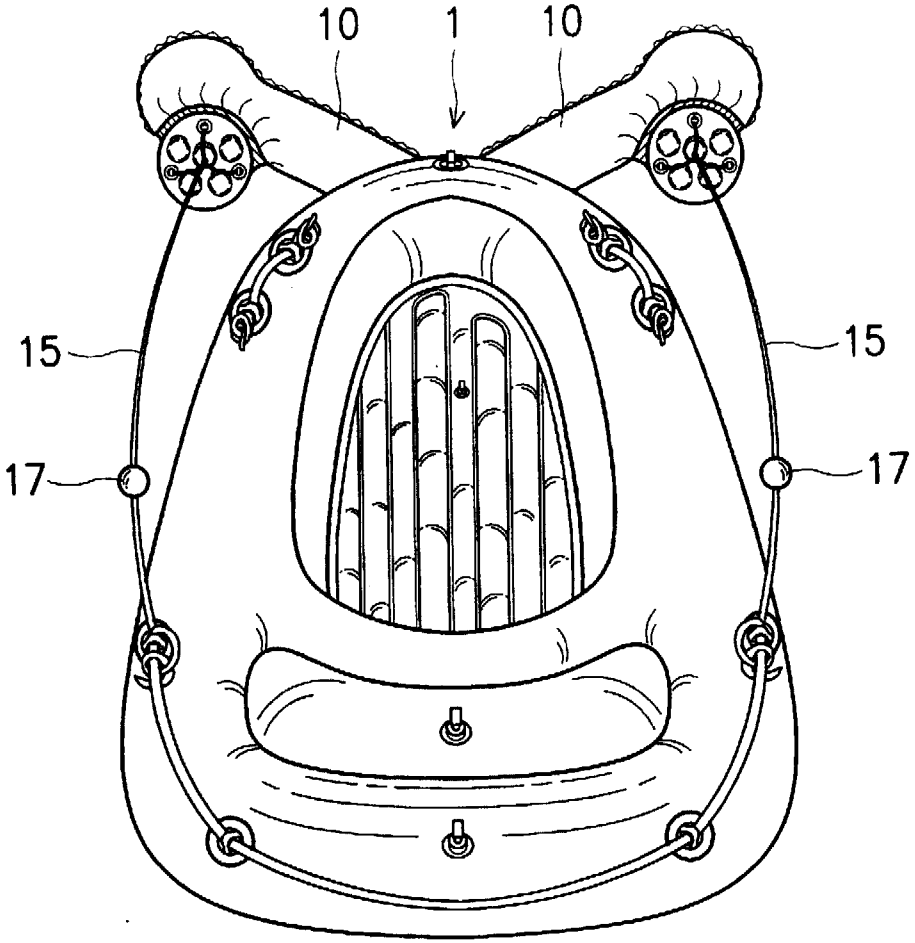
FIG. 1 is a perspective view of an inflatable boat according to an example of this invention.
Figure 2:
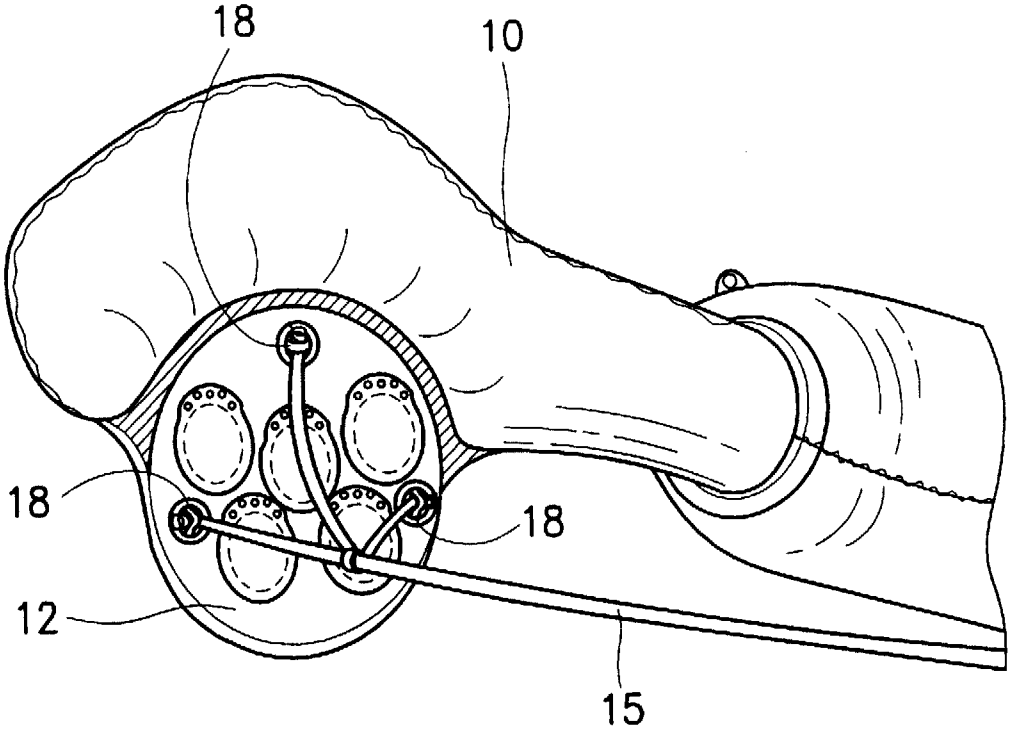
FIG. 2 is a perspective view of an inflatable wing of the inflatable boat according to FIG. 1.

Please refer to FIG. 1 and FIG. 2, in which an inflatable boat 1 according to this invention has a pair of inflatable wings 10 on its bows. Every inflatable wings 10 has a rowing plate 12 to paddle water. Two strings 15 are connected to the rowing plates 12 of the inflatable wings 10 and the stern of the boat 1, while two handles 17 are firmly provided around the strings 15. Sitting on the inflatable boat 1, the child can hold the handles 17 to pull the strings 15 and paddle the water by the rowing plates 12 of the inflatable wings 10. Then, the inflatable boat 1 goes ahead.

Now referring to FIG. 2, there are three hole rings 18 provided on the rowing plate 12. Every string 15 is separated into three strands and then symmetrically tied to the hole rings 18. It is noted that the hole rings 18 are arranged at predetermined positions on the rowing plate 12 so that the rowing plate 12 can be maintained upright under a pull force. Then, the rowing plate 12 can perpendicularly paddle the water to generate the maximum thrust force.

Figure 3:
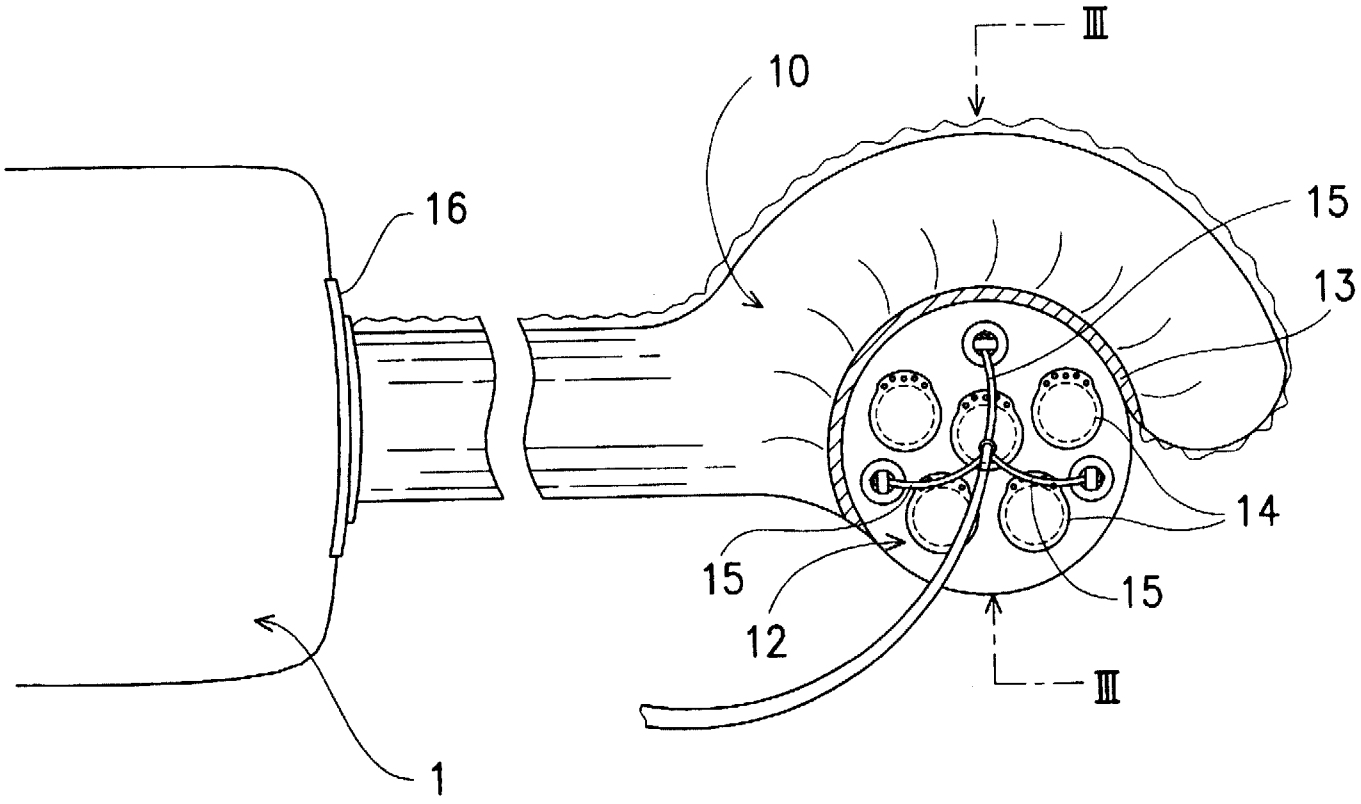
FIG. 3 is a front view of the inflatable wing in FIG. 2.

As shown in FIG. 3, the inflatable wing 10 is welded onto the boat 1 through a flexible material (such as a sheet of plastic) 16. The flexible material 16 functions as a cushion so that the inflatable wing 10 does not directly pull the inflatable boat 1 while waving. It is helpful to prevent a damage to the inflatable boat 1.

Figure 4B:
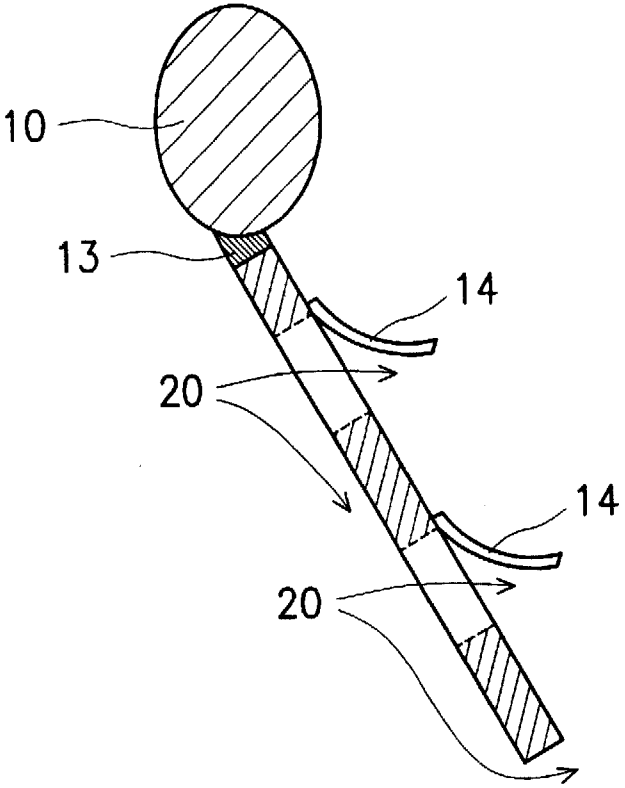
FIG. 4B is a sectional diagram of the inflatable wing according to FIG. 4A, while the inflatable wing moves back to its original position.
Figure 4A:
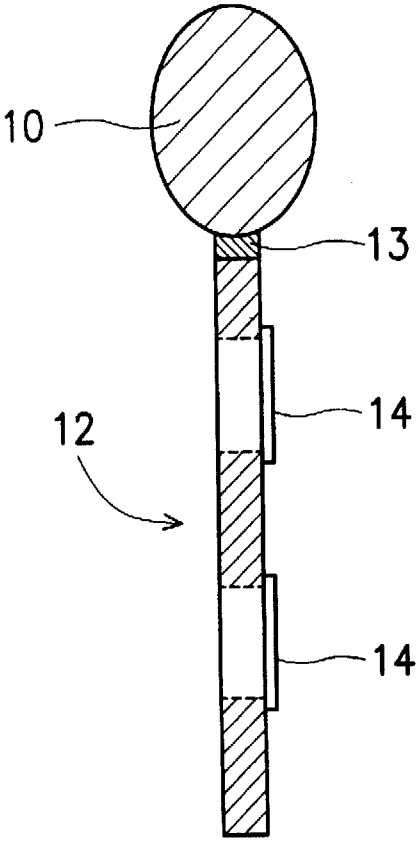
FIG. 4A is a sectional diagram of the inflatable wing along III—III in FIG. 3, while the inflatable wing paddles water.

Referring to FIG. 4A and 4B, a plurality of check valves 14 are provided on the rowing plate 12. Every valve 14 is made of flexible material (or other proper material) and is attached onto the rowing plate 12 with its edge.

It is also noted that the rowing plate 12 is attached to the inflatable wing 10 through creased plastics 13. This arrangement ensures that the rowing plate 12 can be tilted only toward one side. That is, the rowing plate 12 can be tilted toward the right side (FIG. 4B), but can not be tilted toward the left side (FIG. 4A). When the inflatable wing 10 moves toward the right, the rowing plate 12 is maintained upright to perpendicular paddle the water (FIG. 4A). When the inflatable wing 10 returns to its original position, the rowing plate 12 is tilted to decrease the water resistance (FIG. 4B).

The child pulls the handles 17 (or strings 15) to move the inflatable wings 10 backward. At this time the check valves 14 are closed. The rowing plates 12 of the inflatable wings 10 perpendicularly paddle water (FIG. 4A). When the child releases the handles 17, the inflatable wings 10 automatically return to their original positions because of their own stiffness. Also, the check valves 14 are opened to pass water 20 (FIG. 4B). The rowing plate 12 is tilted to decrease the resistance of water.

Figure 5:
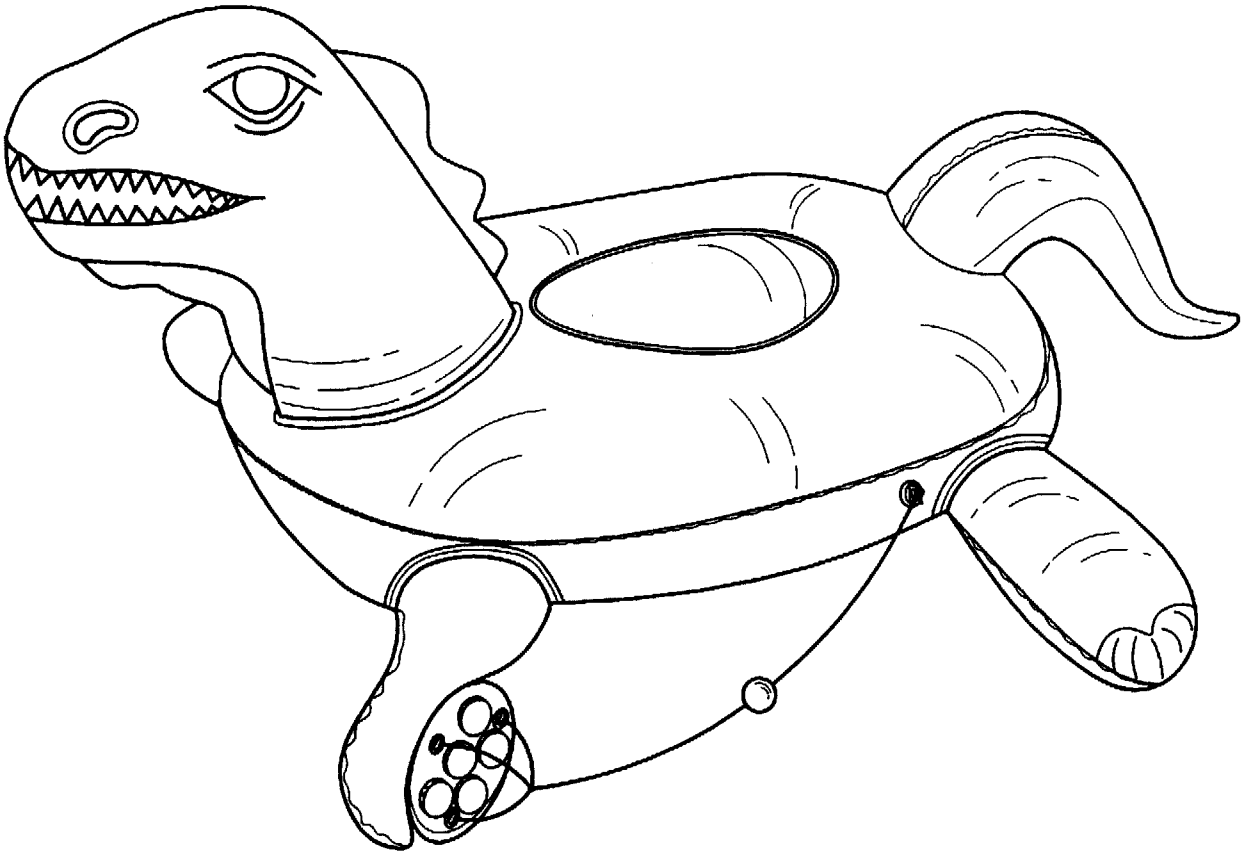
FIG. 5 is a perspective diagram of an inflatable animal according to another example of this invention.

FIG. 5 shows another example of an inflatable boat according to this invention, which is an inflatable animal. The forelegs of the inflatable animal function as the inflatable wings 10 of the inflatable boat 1 of the above example.

Figure 6A:
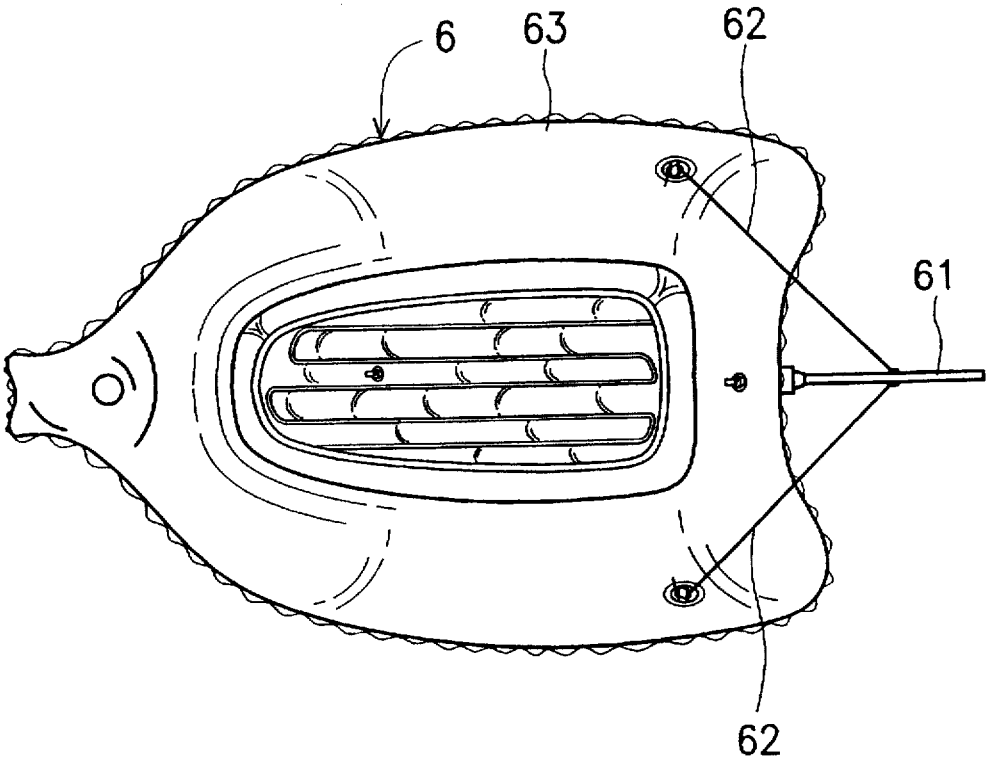
FIG. 6A is a top view of an inflatable tropical fish according to a further example of this invention.
Figure 6B:
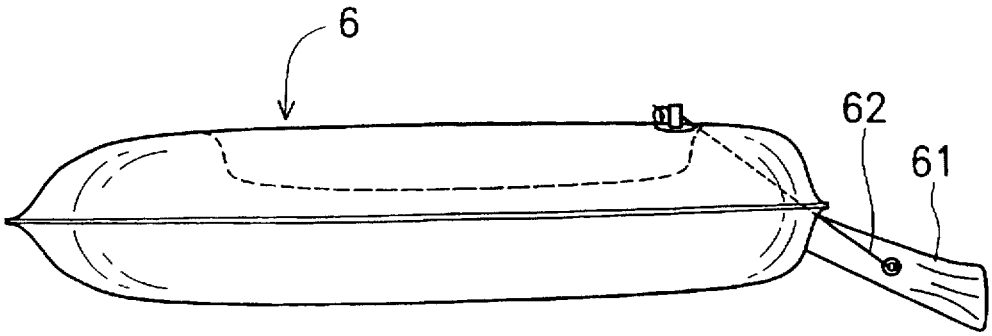
FIG. 6B is a front view of the inflatable tropical fish according to FIG. 6A.
Figure 7:
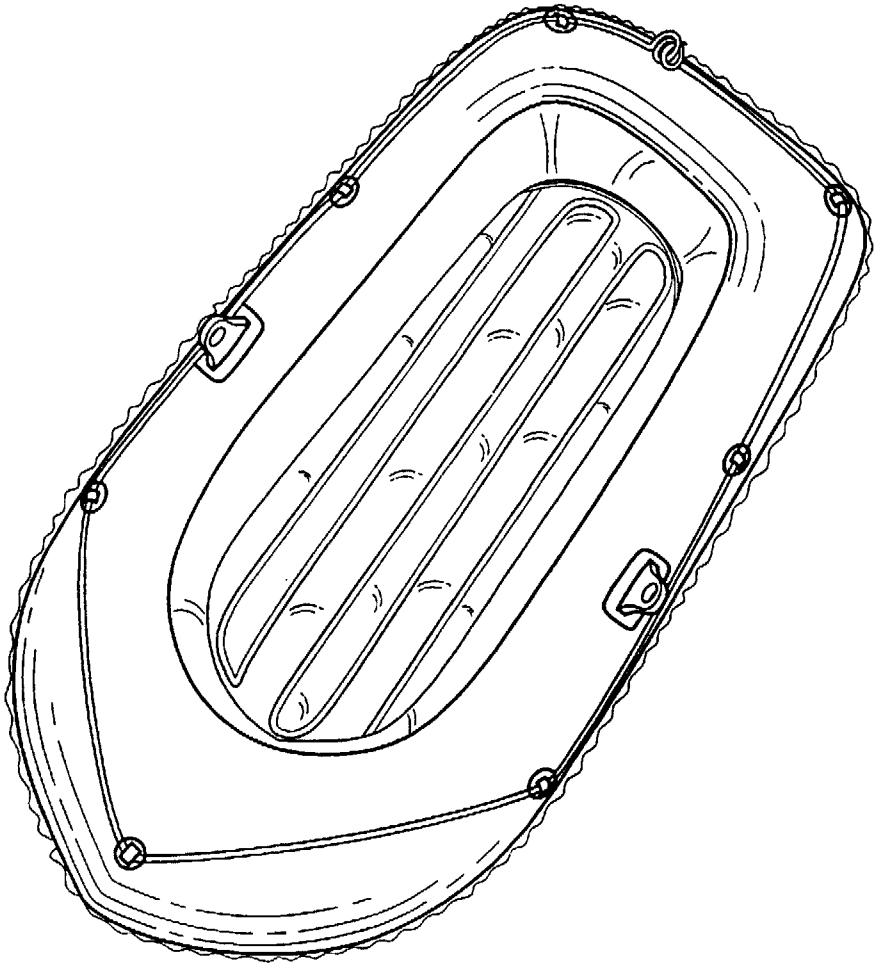
FIG. 7 (PRIOR ART)
FIG. 7 is a perspective diagram of an inflatable boat of the prior art.

FIG. 6A and 6B show a further example of this invention, which is an inflatable tropical fish 6. Two strings 62 are connected to the tail fin 61 and the body 63 of the tropical fish 6. The tail fin 61 is made of flexible material and its end is firmly attached to the fish body 63. The child pulls the strings 62 to wave the tail fin 61. Then, the tropical fish is propelled. According to the experiment, the fish 6 can move one foot by waving its tail fin 61 once, while the tail fin 61 is sixteen inches in length and six inches in width.

Although this invention has been described in its preferred forms and various examples with a certain degree of particularity, it is understood that the present disclosure of the preferred forms and the various examples can be changed in the details of construction. The scope of the invention should be determined by the appended claims and not by the specific examples given herein.

What is claimed is:

1. An inflatable product, comprising:

an inflatable body;

at least one flexible wing member attached to the inflatable body; and at least one holding device connected to the flexible wing member, wherein the flexible wing member is inflatable, and the inflatable wing member further has a rowing plate to paddle the water; and wherein at least one check valve is provided on the rowing plate.

2. The inflatable product as claimed in claim 1, wherein the inflatable wing member further has a rowing plate to which the holding device is connected, at a predetermined position, so that the rowing plate perpendicularly paddles the water.

3. The inflatable product as claimed in claim 2, wherein the rowing plate is attached to the inflatable wing member through a creased portion so that the rowing plate is tilted to decrease the resistance of the water when a pull on the inflatable wing member is released.

4. The inflatable product as claimed in claim 1, further comprising a flexible material through which the inflatable wing member is attached to the inflatable body.

5. An inflatable product, comprising:

an inflatable body;

at least one flexible wing member having two ends, a first end being attached to the inflatable body and a second end extending outwardly away from the inflatable body;

a rowing plate provided on the flexible wing proximate to the second end of the flexible wing member;

at least one holding device connected to the rowing plate such that pulling on the holding device causes the rowing plate and the second end of the flexible wing member to move toward the inflatable body; and at least one check valve provided on the rowing plate, the check valve being arranged such that the valve is open when the rowing plate is pulled toward the inflatable body and the check valve is at least partially open when the rowing plate moves away from the inflatable body.

6. The inflatable product as claimed in claim 5, wherein the flexible wing member is inflatable.

7. The inflatable product as claimed in claim 5, wherein the rowing plate is connected to the holding device at a predetermined position, so that the rowing plate perpendicularly paddles the water.

8. The inflatable product as claimed in claim 5, wherein the rowing plate is attached to the inflatable wing member through a creased portion so that the rowing plate is tilted to decrease the resistance of the water when a pull on the inflatable wing member is released.

9. The inflatable product as claimed in claim 5, further comprising a flexible material through which the inflatable wing member is attached to the inflatable body.

* * * * *